US009303490B2

(12) United States Patent
Pendleton

(10) Patent No.: US 9,303,490 B2
(45) Date of Patent: Apr. 5, 2016

(54) MULTILATERAL JUNCTION SYSTEM AND METHOD THEREOF

(71) Applicant: Bryan P. Pendleton, Cypress, TX (US)

(72) Inventor: Bryan P. Pendleton, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 292 days.

(21) Appl. No.: 14/021,078

(22) Filed: Sep. 9, 2013

(65) Prior Publication Data

US 2015/0068756 A1 Mar. 12, 2015

(51) Int. Cl.

| | |
|---|---|
| ***E21B 43/00*** | (2006.01) |
| ***E03B 3/11*** | (2006.01) |
| ***E21B 41/00*** | (2006.01) |

(52) U.S. Cl.

CPC ..... *E21B 41/0035* (2013.01)

(58) Field of Classification Search

CPC .. E21B 41/0035; E21B 41/0042; E21B 43/14
See application file for complete search history.

(56) References Cited

U.S. PATENT DOCUMENTS 6,158,513 A * 12/2000 Nistor ..... E21B 23/002 166/117.6
7,231,980 B2 6/2007 Murray et al.
7,240,738 B2 * 7/2007 Pendleton ..... E21B 23/00 166/117.5
7,497,264 B2 * 3/2009 Moody ..... E21B 41/0042 166/242.3
7,905,279 B2 * 3/2011 Hart ..... E21B 7/061 166/177.6
8,210,254 B2 * 7/2012 Zweifel ..... E21B 23/002 166/108
8,408,291 B2 * 4/2013 Pendleton ..... E21B 23/002 166/208
8,783,367 B2 * 7/2014 Cronley ..... E21B 23/002 166/208
8,826,991 B2 * 9/2014 Steele ..... E21B 41/0035 166/241.6
2004/0149452 A1 8/2004 Pendleton
2004/0168809 A1 9/2004 Nobileau
2005/0121190 A1 * 6/2005 Oberkircher ..... E21B 41/0035 166/250.1
2009/0255664 A1 10/2009 Hart et al.
2010/0170677 A1 7/2010 Ingraham
2011/0036576 A1 * 2/2011 Schultz ..... E21B 36/02 166/303
2012/0305268 A1 12/2012 Steele
2013/0319666 A1 * 12/2013 Nygardsvoll ..... E21B 41/0035 166/278

OTHER PUBLICATIONS

International Search Report and Written Opinion for PCT Application No. PCT/US2014/049351, dated Nov. 6, 2014, pp. 1-16.
HydraSplit Product Family No. H28922. Wellbore Construction Systems, Product Report. Baker Hughes, Baker Oil Tools. Oct. 2008 pp. 1-2.

* cited by examiner

*Primary Examiner* — Kenneth L Thompson
*Assistant Examiner* — Michael Wills, III
(74) *Attorney, Agent, or Firm* — Cantor Colburn LLP

(57) ABSTRACT

A multilateral junction system includes a multilateral junction device including a first bore leg; a second bore leg; a joint section having a first opening connected to the first bore leg and a second opening connected to the second bore leg. A main body extending from the joint section and including a third opening; and, a tube connected to the third opening. The tube configured to enable an upper completion to be run into a borehole together with the multilateral junction device. Also included is a method of improving multilateral operations in a borehole.

19 Claims, 4 Drawing Sheets

MULTILATERAL JUNCTION SYSTEM AND METHOD THEREOF

BACKGROUND

In the completion and production industry for natural resources, the formation of boreholes for the purpose of production or injection of fluid is common. The boreholes are used for exploration or extraction of natural resources such as hydrocarbons, oil, gas, water, and alternatively for CO2 sequestration.

Multilateral boreholes allow for a greater return on investment associated with drilling and completing simply because more discrete areas/volumes of a subterranean hydrocarbon deposit (or deposits) is/are reachable through a single well. Multilaterals generally require junctions at intersection points where lateral boreholes meet a primary borehole. Junctions are Y type constructions utilized to create flow paths at borehole intersections and are generally referred to as having a primary or main leg and a lateral leg.

For a multilateral junction installation procedure, the main bore section is typically completed first, followed by the lateral completion. These completions are known as lower completions as they refer to the portions of the borehole across the production (or sometimes injection) zones. The lower completions include some sort of perforations, screens, or the like to provide fluidic communication between the lower completion and the surrounding formation. Once the main bore and lateral sections are completed, the multilateral junction is installed, providing the flow paths at the intersection, or the junction can be installed simultaneously with the lateral section. The multilateral junction includes the main leg and lateral leg that are inserted in the main bore and lateral bore, respectively. An uphole portion of the multilateral junction is sized for connection to a liner hanger to anchor the junction to an outer casing. Subsequently, an upper completion is separately installed uphole of the multilateral junction on top of the liner hanger.

The art would be receptive to improved alternative devices and methods for completing a multilateral.

BRIEF DESCRIPTION

A multilateral junction system includes a multilateral junction device including: a first bore leg; a second bore leg; a joint section having a first opening connected to the first bore leg and a second opening connected to the second bore leg; a main body extending from the joint section and including a third opening; and, a tube connected to the third opening, the tube configured to enable an upper completion to be run into a borehole together with the multilateral junction device.

A method of improving multilateral operations in a borehole, the method includes attaching production tubing to a multilateral junction device; and, running the production tubing and the multilateral junction device together within the borehole, wherein the production tubing extends to an uphole location.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
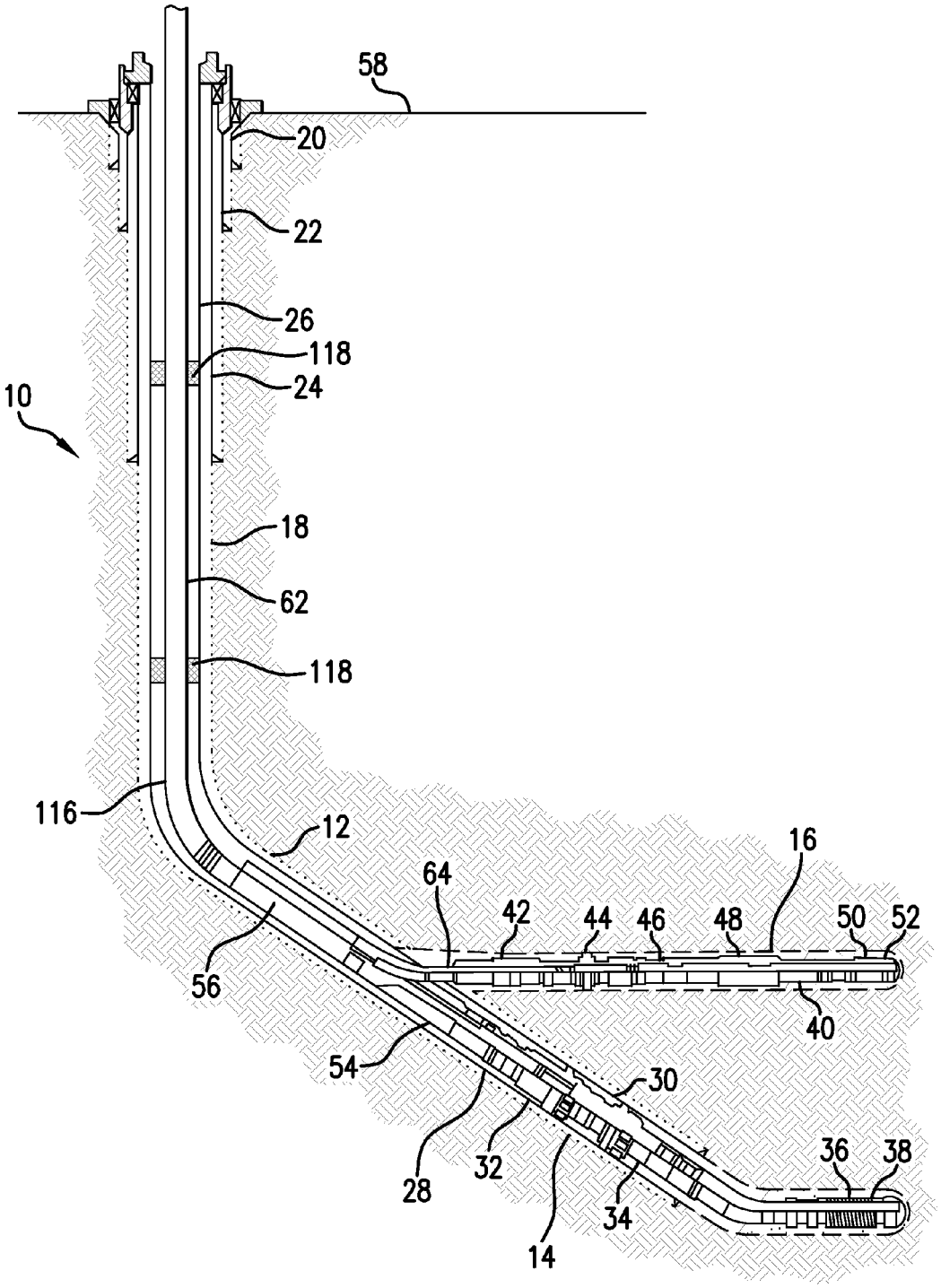
FIG. 1 shows a cross-sectional view of an exemplary embodiment of a multilateral junction system disposed within a multilateral borehole.

With reference to FIG. 1, an exemplary embodiment of a multilateral junction system 10 provided in a multilateral borehole 12. The multilateral borehole 12 is shown including a main bore 14 and a lateral bore 16. The main bore 14 and lateral bore 16 extend from a shared vertical bore 18 which may be cased using any number of casings, such as nested casings 20, 22, 24, and 26. An exemplary lower completion 28 for the main bore 14 set in a casing 30 includes liner hanger and packer assembly 32, gravel pack extension 34, screen 36, and bull plug 38. An exemplary lower completion 40 for the lateral bore 16 includes a lateral entry guide 42, an open hole packer 44, tubing 46, gravel pack extension 48, screen 50, and bull plug 52. Prior to forming the lateral bore 16, a whipstock (not shown) is positioned at an uphole location of the main bore 14 to divert a milling bit through a wall of the main bore 14. A seal bore diverter 54 is used to subsequently divert a lateral bore leg 64 of a multilateral junction device 56 into the already drilled lateral bore 16. A combination whipstock and seal bore diverter system may be employed as disclosed in U.S. Pat. No. 7,905,279, herein incorporated by reference in its entirety. The combination whipstock and seal bore diverter system includes a whipstock that is separable from the diverter 54 such that the whipstock is retrieved to surface location 58 leaving the diverter 54 installed and oriented to receive a later installed multilateral junction device 56.

Figure 2:
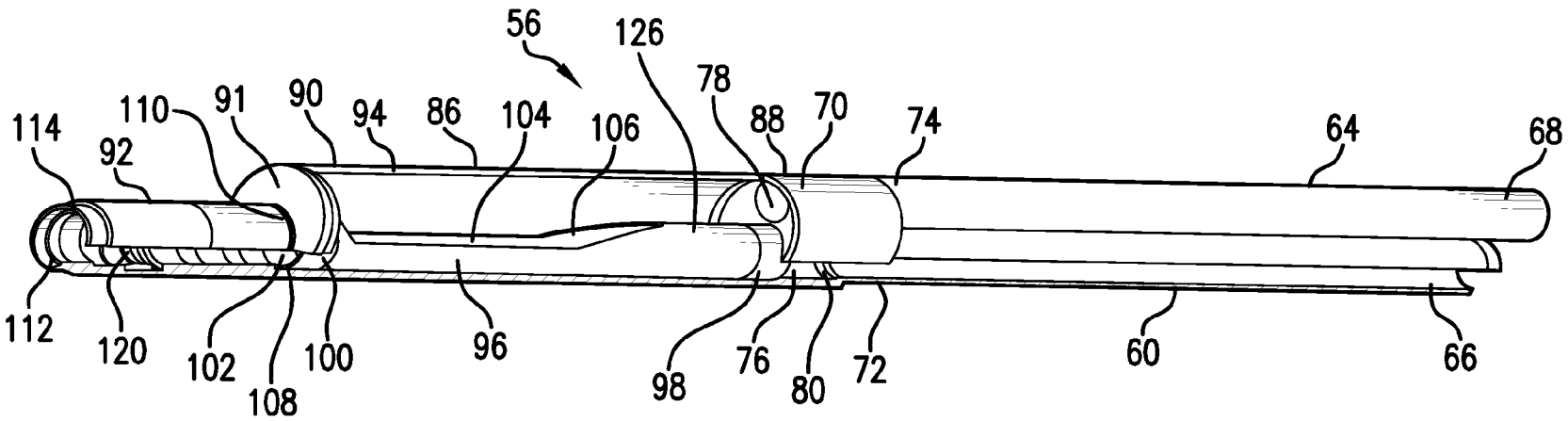
FIG. 2 shows a side perspective, partially exposed view of an exemplary multilateral junction device for the multilateral junction system of FIG. 1.

An exemplary embodiment of the multilateral junction device 56 to be incorporated within the multilateral junction system 10 of FIG. 1 is shown in further detail in FIG. 2. The multilateral junction device 56 includes a main bore leg 60 sized for receipt within a bore of the diverter 54, and fluidically connects the lower completion 28 of the main bore 14 with upper completion 62 (FIG. 1). The main bore leg 60 includes a polished outer diameter to serve as a slick stinger to create a hydraulic seal with the seal bore diverter 54. A lateral bore leg 64 of the multilateral junction device 56 is diverted from the main bore 14 and into the lateral bore 16 by a face of the diverter 54. It should be understood that while the main bore leg 60 and the lateral bore leg 64 are depicted in FIG. 2 in close proximity, the downhole portions 66, 68 of the main bore leg 60 and the lateral bore leg 64 are configured to separate from one another to follow the paths of the main bore 14 and lateral bore 16, respectively, as exemplified in FIG. 1.

The multilateral junction device 56 further includes a joint section 70 to which an uphole end 74 of the lateral bore leg 64 and an uphole end 72 of the main bore leg 60 is attached. The joint section 70 includes a first opening 76 accessing the main bore leg 60 and a second opening 78 accessing the lateral bore leg 64. In the illustrated embodiment, the joint section 70 includes a seal bore 80 (a polished bore configured to accept a seal assembly), such as a seal bore 80 within opening 76. While a seal bore 80 is not illustrated within opening 78, the joint section 70 may include an additional seal bore therein. A downhole tool, such as downhole tool 82 shown in FIG. 3, having a seal assembly 84 may thus be seated within the seal bore 80 and sealed therein as necessary. Thus the joint section 70 can be utilized to effectively seal off production between the main bore leg 60 and the lateral bore leg 64 or perform other downhole operations as production demands.

Uphole of the joint section 70 is a main body 86 extending therefrom. The main body 86 includes a downhole end 88 extending from the joint section 70 and an uphole end 90 having an end face 91 connected to a tube 92. The main body 86 includes an outer body 94, the outer body 94 having an outer diameter substantially matching that of the joint section 70, and a tubular inner window sleeve 96 eccentrically positioned within the outer body 94. The window sleeve 96 provides access to both the first opening 76 and main bore leg 60 and the second opening 78 and lateral bore leg 64. A downhole end 98 of the window sleeve 96 is connected at least substantially axially with the first opening 76, and an uphole end 100 of the window sleeve 96 is connected at least substantially axially with an opening 102, hereinafter a third opening for convenience in description, in the uphole end 90 of the main body 86. While the window sleeve 96 is shown in substantial axial alignment with the first opening 76, the window sleeve 96 is provided with a window 104 in the tubular structure of the window sleeve 96 which provides radial access to a remainder of the outer body 94 and fluidic access to the second opening 78 and lateral bore leg 64. In an alternative embodiment, the window 104 may include an orienting edge surface 106, such as a helical edge surface, for use with a self orienting and locating downhole tool 83, as will be further described below. The third opening 102 in the main body 86 may also include a seal bore 108.

The tube 92 of the multilateral junction device 56 includes a downhole end 110 connected to the third opening 102 in the main body 86. The tube 92 is axially aligned with the third opening 102, and is thus at least substantially axially aligned with the window sleeve 96 and the first opening 76 in the joint section 70. While the tube 92, third opening 102, and window sleeve 96 have been described as being substantially axially aligned with the first opening 76 and main bore leg 60, another exemplary embodiment may instead provide the tube 92, third opening 102 in the uphole end 90 of the main body 86, and window sleeve 96 in substantial axial alignment with the second opening 78 and lateral bore leg 64. The tube 92 is sized for production there through and incorporates threads 112 at an uphole end 114 thereof for connection with additional lengths of production tubing 116 (FIG. 1). The tube 92 and/or production tubing 116 may be secured with the casing 26, which serves as an outer tubular, using one or more expandable packers 118. The production tubing 116, which serves as part of the upper completion 62, is secured to the tube 92 prior to running the multilateral junction device 56 into the multilateral borehole 12. Thus, once the multilateral junction device 56 is run into the borehole 12, with the main bore leg 60 and lateral bore leg 64 positioned in the main bore 14 and lateral bore 16, respectively, and the packers 118 are set, the system 10 is ready for production due to the upper completion 62 already being put in place. While the upper completion 62 including production tubing 116 is described herein as a main conduit for the transportation of hydrocarbons from the bores 14, 16 to the surface location 58, it should be understood that the system 10 is also useful for the injection of materials from the surface 58 to the bores 14, 16.

Figure 3:
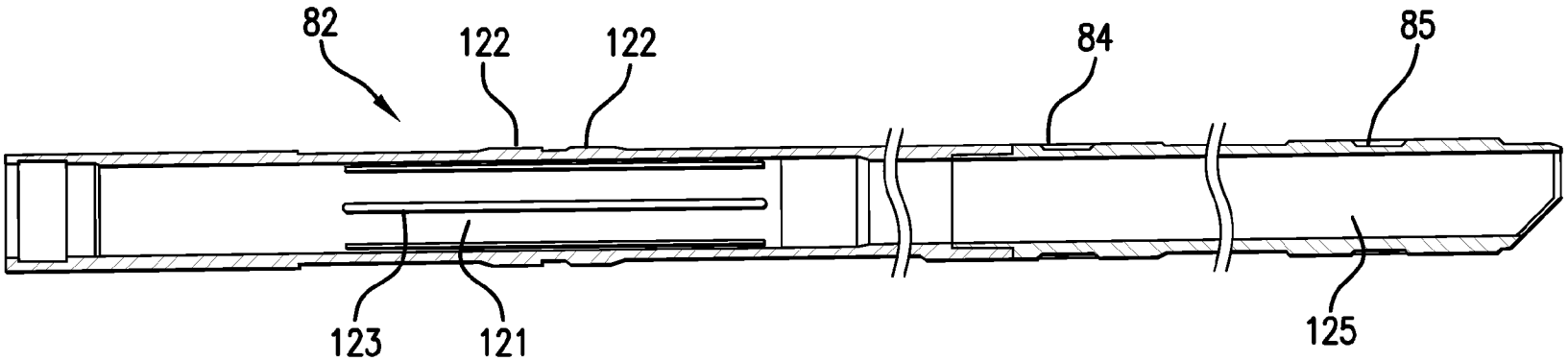
FIG. 3 shows a cross-sectional view of an exemplary downhole tool for use in the multilateral junction device of FIG. 2.
Figure 4:
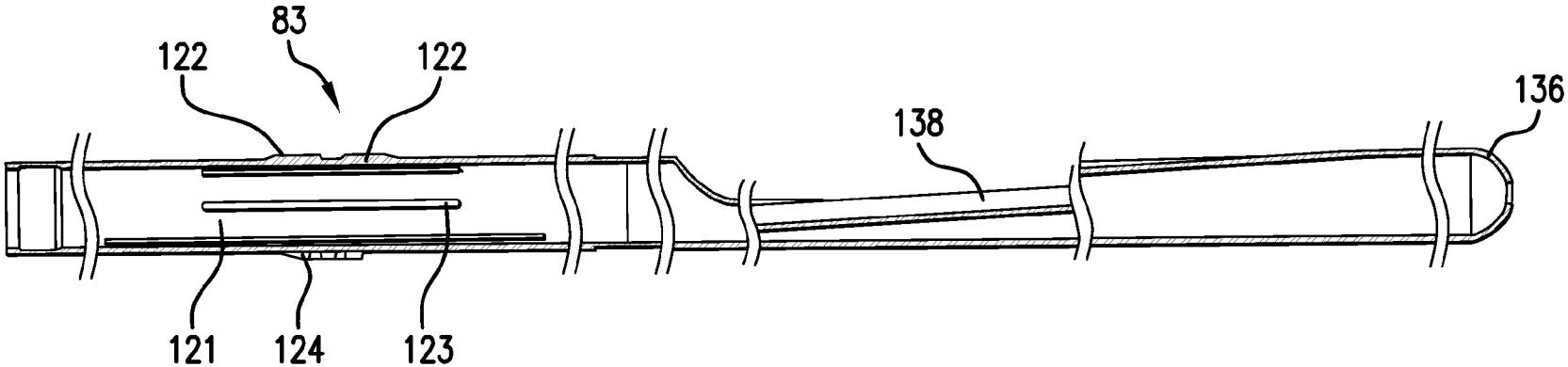
FIG. 4 shows a cross-sectional view of another exemplary downhole tool for use in the multilateral junction device of FIG. 2; and, FIG. 5 shows a cross-sectional view of an exemplary embodiment of a stacked multilateral junction system disposed within a multilateral borehole.

An interior of the tube 92 includes an orientation profile 120, such as a helical profile or matching profiles, to provide downhole tools (such as downhole tool 82 shown in FIG. 3 and downhole tool 83 shown in FIG. 4) insertable within the multilateral junction device 56 an orientation reference on an inside of the tube 92. The orientation profile 120 may be used in conjunction with the orienting edge surface 106 of the window sleeve 96 to provide orienting reference information for the proper insertion of downhole tools through the tube 92 and main body 86. Such downhole tools may include, but are not limited to, flow control tools, tools needed to access the lateral bore 16, diverters to shut off the flow from one or the other of the lateral bore 16 and main bore 14, etc. As shown in FIGS. 3 and 4, an exemplary embodiment of the downhole tool 82 and downhole tool 83 each include a collet 121 with cooperating profiles 122 that are engageable with the orientation profile 120 within the tube 92. Slots 123 provide for inward radial compression of the profiles 122 as they pass through inner diameters of the tube 92 that are smaller than an outer diameter of the profiles 122. When the orientation profile 120 is reached, the collet 121 allows the profiles 122 to move radially outward and be seated within the profile 120. FIG. 4 depicts an exemplary embodiment that may further include a key 124 that is slidable along an orienting surface adjacent the orientation profile 120 to orient the tool 83 to a proper rotational position for its intended use. As shown, the key 124 is positioned to orient a window opening 138 towards the second opening 78. If the orienting surface 106 of the window sleeve 96 is also or alternatively employed to orient a downhole tool to a proper rotational position for its intended use, then the window sleeve 96 may further include a slotted longitudinal opening 126 at a downhole end of the orienting edge surface 106 so that a key on the tool can continue to extend through the longitudinal opening 126 to allow the downhole tool further movement in a downhole direction as needed. The downhole tools 82, 83 may be structured to include a self orienting selectable locating collet, where the collet is provided with an orientation key and a collet profile disposed at an outside dimension of the collet, as described by U.S. Pat. No. 7,240,738, herein incorporated by reference in its entirety. Thus, the multilateral junction device 56 having the orientation profile 120 within the tube 92 and/or the orienting edge surface 106 of the window sleeve 96 provides features that can cooperate with downhole tools 82, 83 that may require specific positioning for proper operation. Also, the seal bores 80, 108 at the uphole and downhole ends 90, 88 of the main body 86 and joint section 70 allow for the seal assemblies 84, 85 of downhole tool 82 to be sealed therein as necessary. The exemplary tool 82 of FIG. 3 is depicted with a longitudinal passageway 125 that is not blocked, thus allowing fluid flow there through or the passage of tools there through. When inserted within the junction device 56 illustrated in FIG. 2, the tool 82 effectively seals the passageway 125 from the lateral bore leg 64, via seals 84, 85. The exemplary tool 83 of FIG. 4 is depicted with a plug 136 for blocking the main bore leg 60 and window opening 138 for allowing fluidic communication between the lateral bore leg 64 and production tubing 116. While two exemplary tools 82, 83 have been shown, it should be understood that various downhole tools may be inserted within the multilateral junction device 56.

Figure 5:
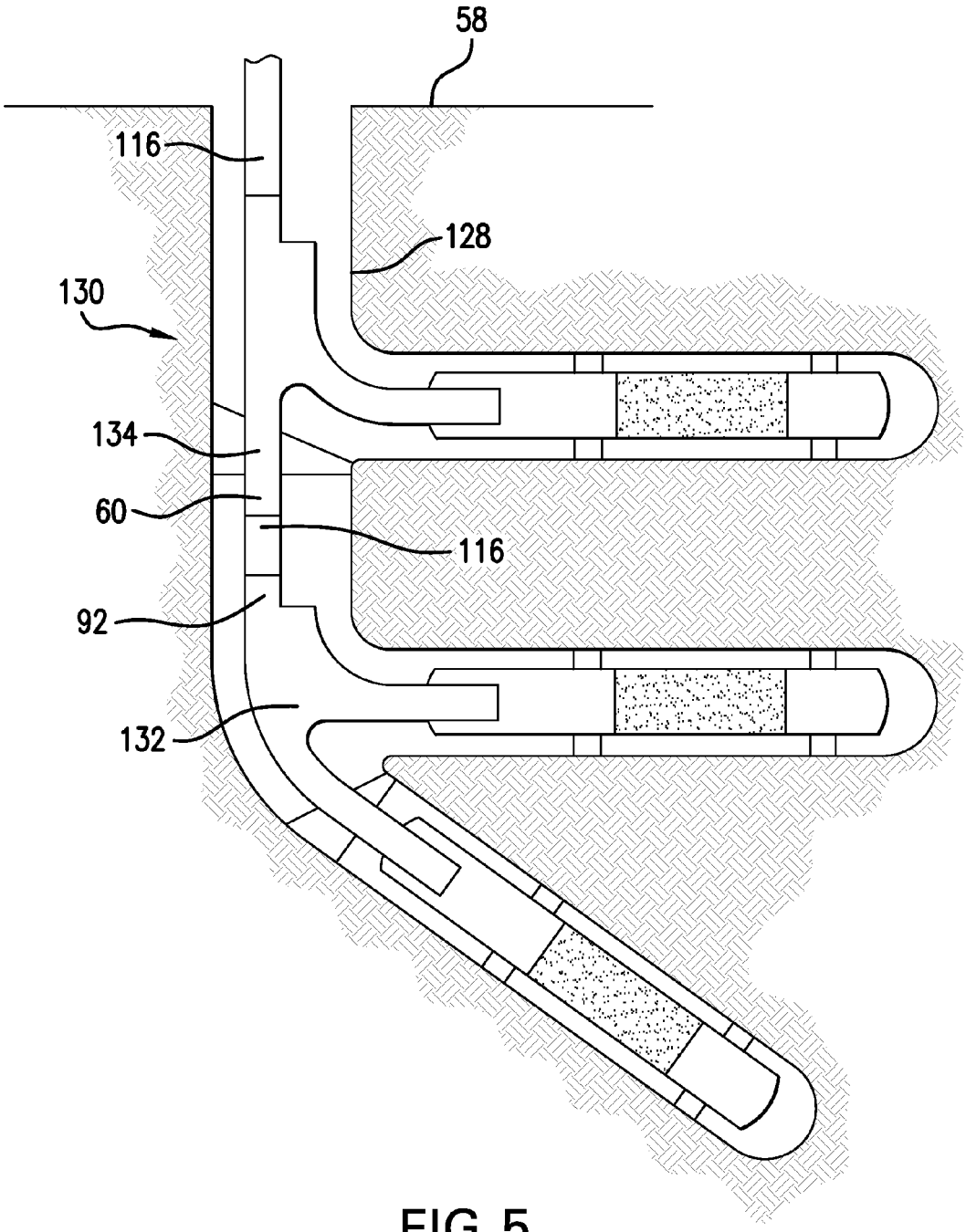

While FIG. 1 depicts a single multilateral junction device 56 within the multilateral junction system 10, the tube 92 of the multilateral junction device 56 enables two or more multilateral junction devices 56 to be "stacked" or integrated into the multilateral junction system 10. FIG. 5 shows an exemplary embodiment of a multilateral junction system 130 where first and second multilateral junction devices 132, 134 are installed in a multilateral borehole 128. The main bore leg 60 of the second multilateral junction device 134 may be connected directly to the tube 92 of the first multilateral junction device 132 or may be separated by a length of production tubing 116. Details of the multilateral junction devices 132, 134 may be found in the above-provided description of multilateral junction device 56.

Thus, the multilateral junction system 10 described herein provides for a method of improving multilateral operations in a borehole 12, the method including attaching production tubing 116 to a multilateral junction device 56, and running the production tubing 116 and the multilateral junction device 56 together within the borehole 12, wherein the production tubing 116 extends to a surface location 58. By eliminating the need to separately run in an upper completion, the multilateral junction system 10 saves time which inevitably leads to reduced expenses.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A multilateral junction system comprising:

a multilateral junction device including:

a first bore leg;

a second bore leg;

a joint section having a first opening connected to the first bore leg and a second opening connected to the second bore leg;

a main body extending from the joint section and including a third opening;

a tubular inner window sleeve positioned within the main body, the window sleeve extending from the third opening to the joint section, the window sleeve including a radially directed window, the window including a first portion and a second portion, the first portion enabling fluidic communication between the first and third openings and between the second and third openings, the second portion having a different outer peripheral edge than the first portion, the second portion including an orientation edge surface configured to cooperate with an exterior orientation feature of a downhole tool; and, a tube connected to the third opening, the tube configured to enable an upper completion to be run into a borehole together with the multilateral junction device.

2. The multilateral junction system of claim 1 wherein the tube is threaded and configured for attachment to production tubing.

3. The multilateral junction system of claim 2 further comprising the production tubing threadably connected to the tube.

4. The multilateral junction system of claim 3 further comprising a production packer configured to secure at least one of the multilateral junction device and the production tubing to an outer tubular.

5. The multilateral junction system of claim 1 wherein the tube is substantially axially aligned with one of the first opening and the second opening.

6. The multilateral junction system of claim 1 wherein the tube has a substantially same inner diameter as the first bore leg.

7. The multilateral junction system of claim 1 wherein the tube is integral with an end face of the main body.

8. The multilateral junction system of claim 1 wherein the tube includes an interior orientation profile configured to engage with downhole tools having cooperating exterior orientation profiles.

9. The multilateral junction system of claim 1 wherein the orientation edge surface includes a helical edge surface.

10. The multilateral junction system of claim 1 further comprising first and second longitudinally spaced through-tubing seal bores within the joint section configured to receive a seal assembly of a downhole tool inserted through the multilateral junction device.

11. The multilateral junction system of claim 1 further comprising a seal bore diverter receiving the first leg there through and diverting the second leg at a non-zero angle from the first leg.

12. The multilateral junction system of claim 1 further comprising a longitudinal opening in the window sleeve, the longitudinal opening extending between the second portion of the window and the joint section, the longitudinal opening configured to accept a key of the tool.

13. A method of improving multilateral operations in a borehole, the method comprising:

attaching production tubing to the multilateral junction device of claim 1; and, running the production tubing and the multilateral junction device together within the borehole, wherein the production tubing extends to an uphole location.

14. The method of claim 13, further comprising installing the multilateral junction device at a location where a lateral bore diverts from a main bore.

15. The method of claim 13, wherein attaching the production tubing to a multilateral junction device includes threading the production tubing onto the tube of the multilateral junction device prior to running the production tubing and multilateral junction device within the borehole.

16. The method of claim 13, further comprising running a downhole tool within the production tubing and multilateral junction device and engaging orienting reference features of the downhole tool with orienting reference features within the multilateral junction device.

17. The method of claim 13, further comprising securing at least one of the production tubing and the multilateral junction device to an outer tubular via an expandable packer.

18. The method of claim 13 wherein the multilateral junction device is a first multilateral junction device, and further comprising attaching a second multilateral junction device to the first multilateral junction device.

19. The method of claim 18, further comprising attaching a length of production tubing between the first and second multilateral junction devices.

* * * * *